United States Patent [19]

Beldam

[11] 4,258,785

[45] Mar. 31, 1981

[54] HEAT EXCHANGER INTERPLATE FITTING

[75] Inventor: Richard P. Beldam, Mississauga, Canada

[73] Assignee: Borg-Warner Corporation, Chicago, Ill.

[21] Appl. No.: 119,737

[22] Filed: Feb. 8, 1980

[51] Int. Cl.[3] ..... F28F 9/26

[52] U.S. Cl. ..... 165/175; 165/153; 165/170

[58] Field of Search ..... 165/152, 153, 166, 167, 165/170, 173, 175

[56] References Cited

U.S. PATENT DOCUMENTS

| | | | |
|---|---|---|---|
| 2,639,899 | 5/1953 | Young | 165/175 X |
| 2,930,590 | 3/1960 | Sartori et al. | 165/175 X |
| 3,207,216 | 9/1965 | Donaldson | 165/175 X |
| 3,670,812 | 6/1972 | Bemrose | 165/175 |
| 4,011,905 | 3/1977 | Millard | 165/175 |
| 4,019,573 | 4/1977 | Modine | 165/175 |
| 4,172,496 | 10/1979 | Melnyk | 165/178 X |

FOREIGN PATENT DOCUMENTS

| | | | |
|---|---|---|---|
| 1451258 | 12/1963 | Fed. Rep. of Germany | 165/175 |
| 849839 | 12/1939 | France | 165/175 |
| 113651 | 2/1917 | United Kingdom | 165/153 |

*Primary Examiner*—Sheldon J. Richter

*Attorney, Agent, or Firm*—James A. Geppert

[57] ABSTRACT

An interplate inlet, outlet or other suitable fitting for use in a closely stacked plate heat exchanger which allows the placement of the fitting between the plates at any point along the length of the inlet or outlet header tank formed by the heat exchange plates. The fitting includes a pair of oppositely disposed facing substantially identical plates providing bubbles aligned with the bubbles at the ends of the heat exchanger plates and opening into a laterally extending conduit to be joined to a fluid hose or to receive appropriate fittings to receive a sensor or having internal threads to receive an externally threaded fitting.

10 Claims, 10 Drawing Figures

HEAT EXCHANGER INTERPLATE FITTING

BACKGROUND OF THE INVENTION

Stacked plate heat exchangers made up of plates which form integral header tanks typically use inlet and outlet fittings which are attached to one end of each tank as shown in U.S. Pat. No. 3,207,216. This location is not always compatible with installation restraints, however, other fitting locations could not heretofore be utilized without introducing post-braze manufacturing operations; such operations comprising the cutting into the tanks and welding the fittings in place.

SUMMARY OF THE INVENTION

The present invention comprehends the location of inlet, outlet or other fittings at any desired position along the header tank formed by the stacking of plates to provide a closely stacked plate heat exchanger. The standard core plates forming the heat exchanger have an elongated generally flat or ribbed portion with a raised flange or bubble at each end having an enlarged opening therein. The central generally flat portion of each plate has a peripheral flange abutting a second facing plate to provide an enclosed passage, and the oppositely extending bubbles at each end abut the bubbles of adjacent plates with the openings aligned to provide enlarged header tanks at the opposite ends of the heat exchanger. To permit insertion of a fitting having its own bubble, the abutting bubble halves of two adjacent plates are omitted and the fitting bubble inserted to form a portion of the header tank.

The present invention also comprehends the provision of a novel fitting that is formed of two generally symmetrical halves having a bubble portion that enlarges into a semi-cylindrical half of a conduit or fitting portion. As the fitting halves are formed of sheet material in the same manner as the core plates, the entire assembly may be stacked together and brazed; thus eliminating any post braze manufacturing operation.

The present invention further comprehends the provision of a fitting to be inserted as an integral portion of a header tank wherein the fitting may form an inlet or outlet conduit to be appropriately attached to hoses or tubing, or the fitting can be provided with suitable adapters to provide an internally threaded connection or a friction fit connection to receive a sensor, flow gauge or other appropriate member.

Further objects are to provide a construction of maximum simplicity, efficiency, economy and ease of installation and operation, and such further objects, advantages and capabilities as will later more fully appear and are inherently possessed thereby.

DESCRIPTION OF THE PREFERRED EMBODIMENTS

Figure 1:
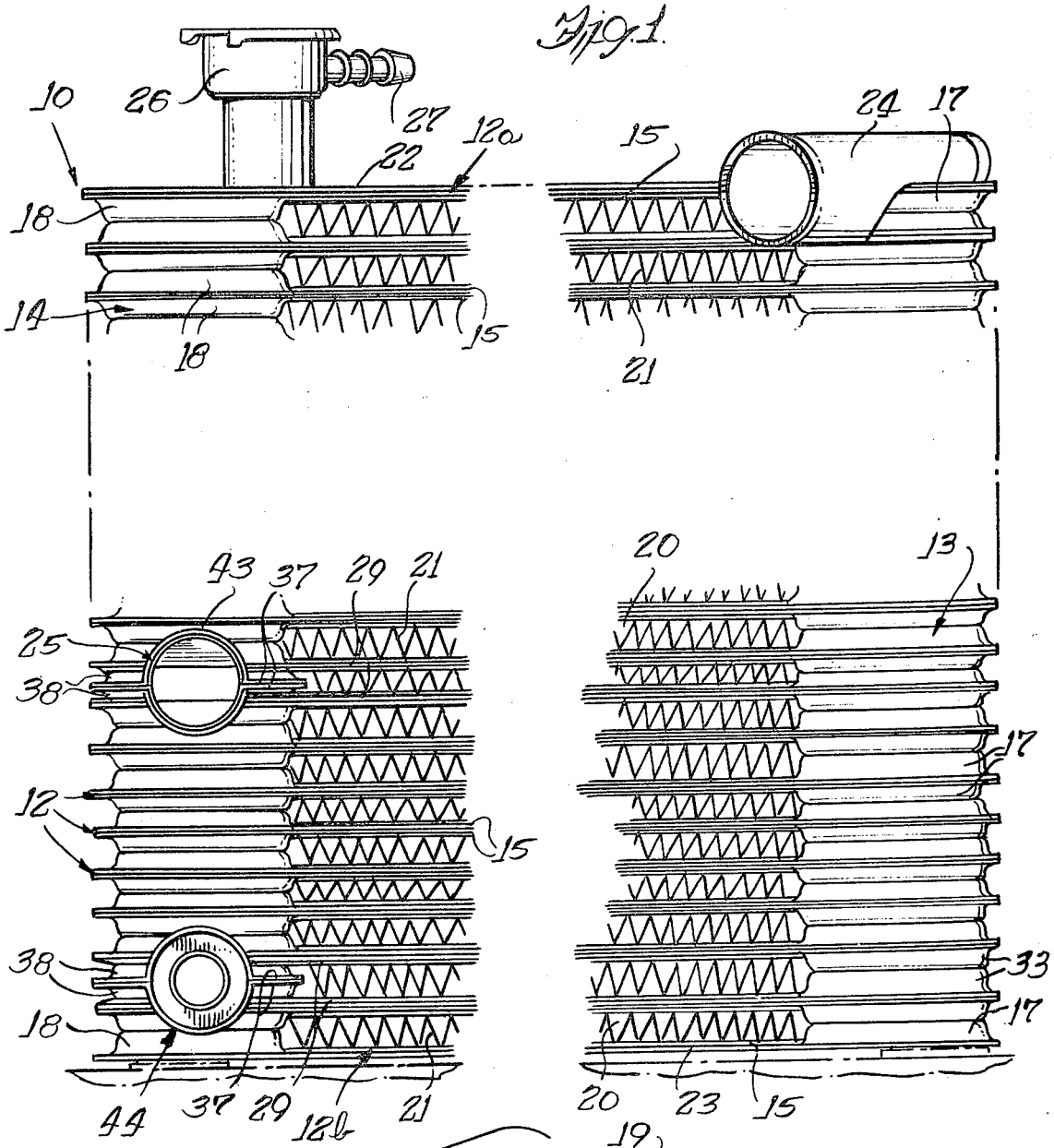
FIG. 1 is a rear elevational veiw, with portions broken away, of a stacked plate heat exchanger incorporating the fittings of the present invention.
Figure 2:
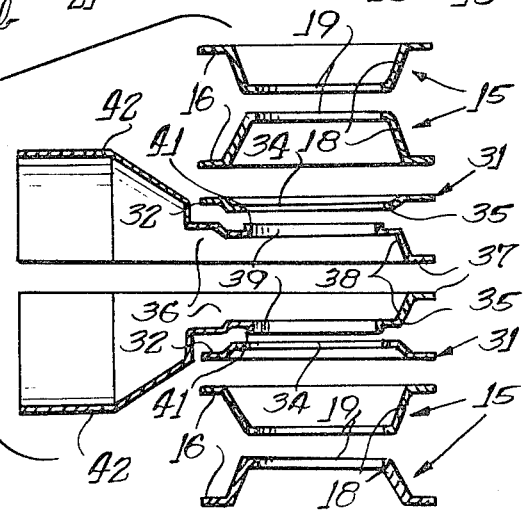
FIG. 2 is an exploded cross sectional view taken on the line 4—4 of FIG. 3 of a fitting and the adjacent core plates.
Figure 3:
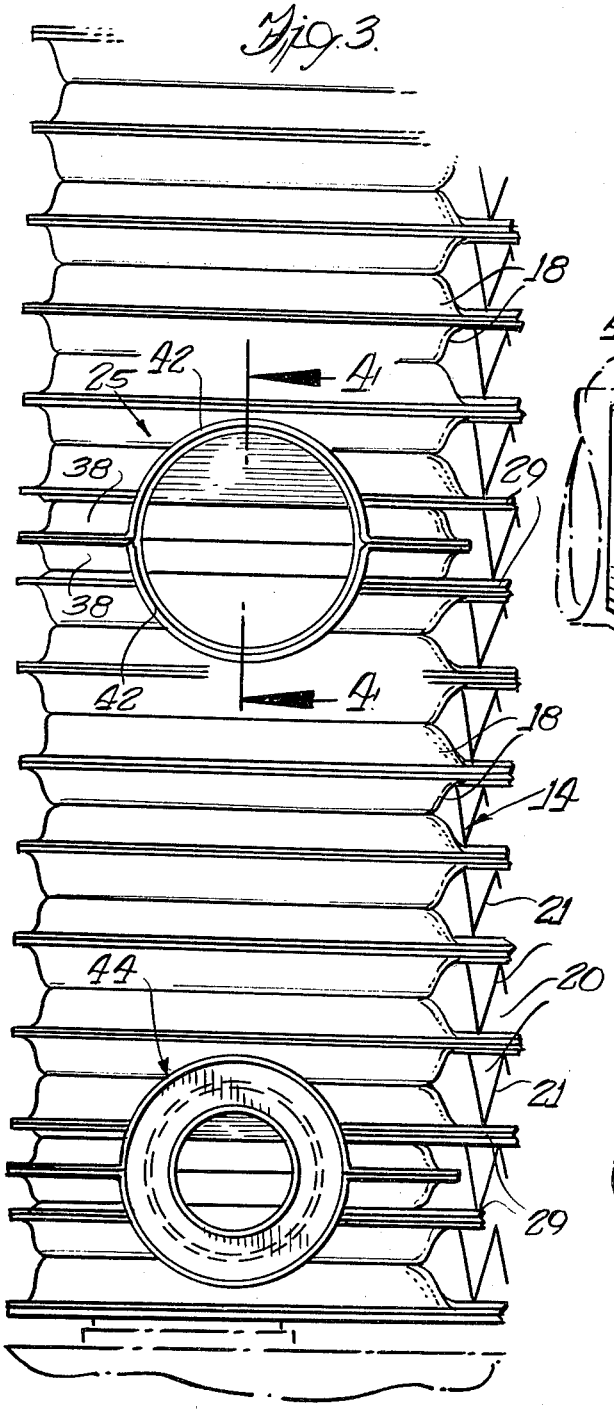
FIG. 3 is an enlarged partial rear elevational view of a header tank containing the fittings of the present invention.
Figure 5:
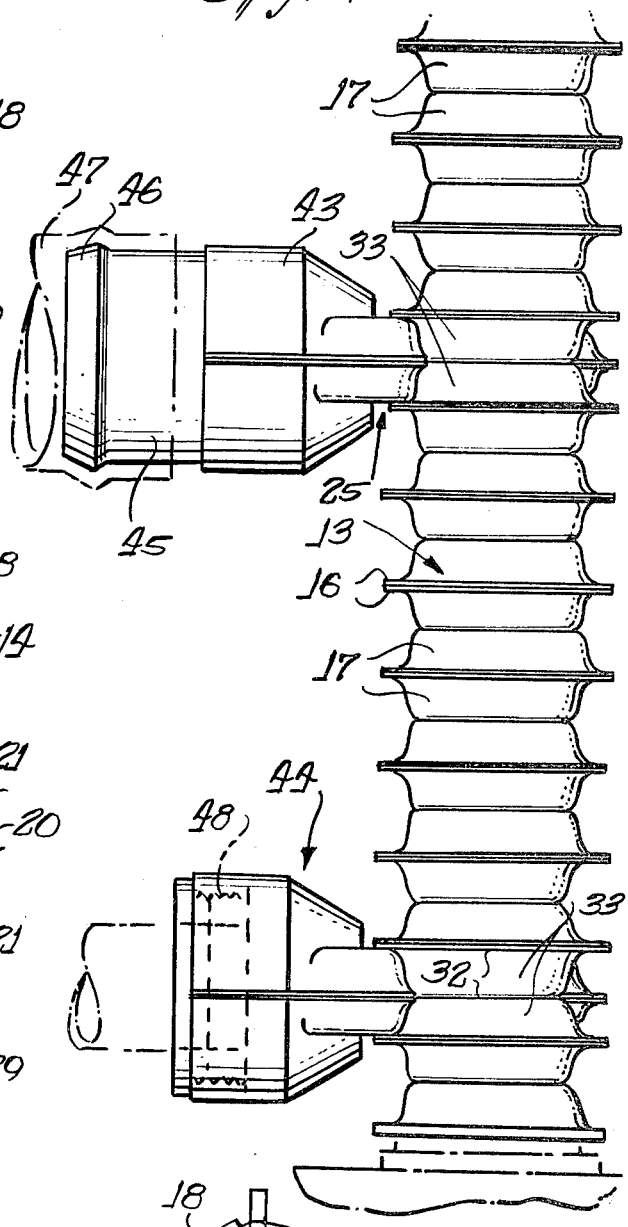
FIG. 5 is a partial side elevational view of the heat exchanger taken from the right hand side of FIG. 1.

Referring more particularly to the disclosure in the drawings wherein is shown an illustrative embodiment of the present invention, FIG. 1 discloses a closely stacked plate, cross flow, heat exchanger 10, such as used for an automobile radiator, including a plurality of heat exchange plates 12 having enlarged portions at the opposite ends thereof to form inlet and outlet header tanks 13 and 14. Each plate is formed of a pair of facing dished members 15,15 bonded together along their peripheral edges 16,16 and provided with raised portions or bubbles 17,17 or 18,18 at the opposite ends having oppositely disposed enlarged openings 19 therein; the oppositely disposed bubbles 17,17 or 18,18 combining to form the enlarged header tank portions 13 or 14, respectively.

The pair of facing dished members 15,15 form an elongated flow passage extending between the bubbles 17,17 and 18,18, and the spacing 20 formed between the pairs of dished members provides for air flow between the flow passages and has a folded or corrugated metal heat transfer surface 21 therein. The openings 19 in the bubbles 17 or 18 are axially aligned to provide a vertical flow passage through the header tank 13 or 14.

The top plate **12*a* and the bottom plate 12*b* are each formed of a dished member 15 having opposite end bubbles 17 and 18 and a flat top plate 22 or bottom plate 23 bonded to the peripheral edge 16 of the respective dished member 15. An inlet fitting 24 adapted to be connected to a suitable hose or conduit is bonded onto the top plate 22 and communicates with an opening in the plate (not shown) axially aligned with the header tank 13. An outlet fitting 25 is provided in the header tank 14 at a point intermediate the ends thereof of a construction to be later described. A pressure fitting 26 may be secured to the upper flat plate 22 at an opening generally aligned with the header tank 14 and has an overflow fitting 27** thereon; the fitting receiving a suitable pressure cap (not shown). Suitable support members (not shown) may be inserted into the assembly to provide a means of mounting a fan shroud or electric fan assembly onto the heat exchanger.

To allow for the insertion of the fitting 25 into the stacked plate assembly, a pair of modified heat exchange plates 29,29 are utilized with each plate being a combination of a dished member 15 and a dished member 31 having a peripheral edge 32 with a bubble 33 at one end and an enlarged opening 34 at the opposite end in the flat surface 35 of the dished member 31. In the instance of the fitting 25, the bubbles 33,33 at the one end of the two plates members 31,31 abut and are joined together with the openings therefor axially aligned with header tank 13, and the oppositely facing peripheral edges 31,31 are joined to the edges 16 of the adjacent dished members 15,15 to complete the flow passages of these two plates for the header tank 13. The openings 34,34 in flat surfaces 35,35 of the plates 31,31 are axially aligned with the openings in the bubbles 18 for the header tank 14.

Figure 4:
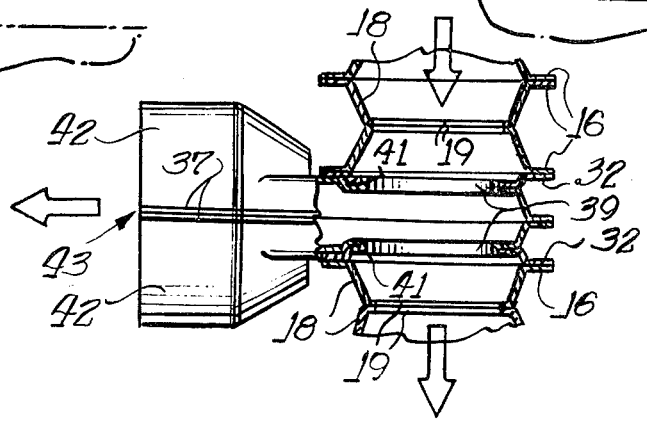
FIG. 4 is a vertical cross sectional view with a portion in elevation of the fitting taken on the line 4—4 of FIG. 3.
Figure 6:
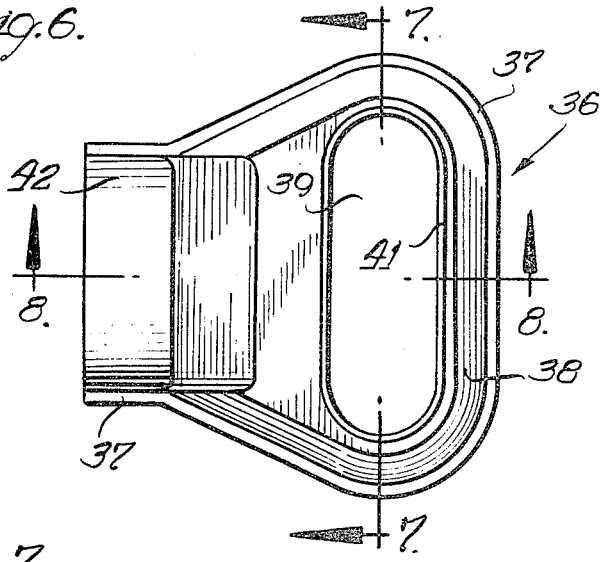
FIG. 6 is an enlarged top plan view of a piece forming one-half of the fitting.
Figure 7:
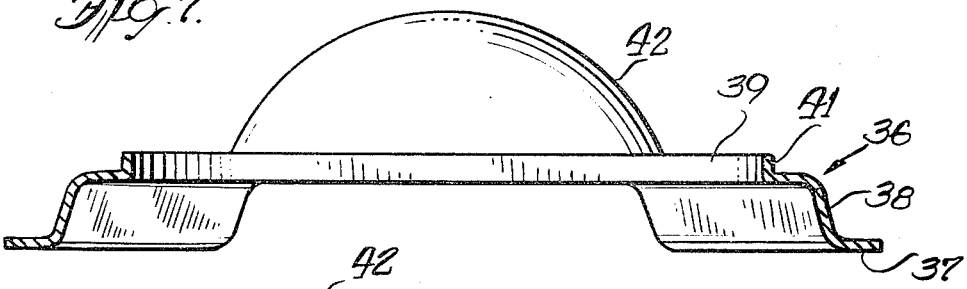
FIG. 7 is a vertical cross sectional view taken on the line 7—7 of FIG. 6.
Figure 8:
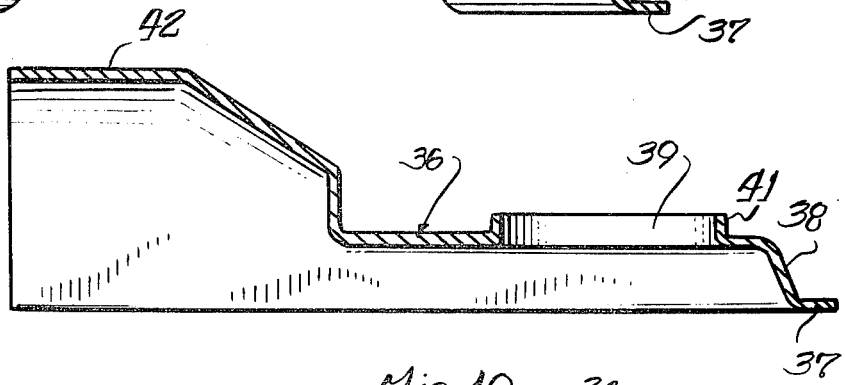
FIG. 8 is a vertical cross sectional view taken on the line 8—8 of FIG. 6.
Figure 9:
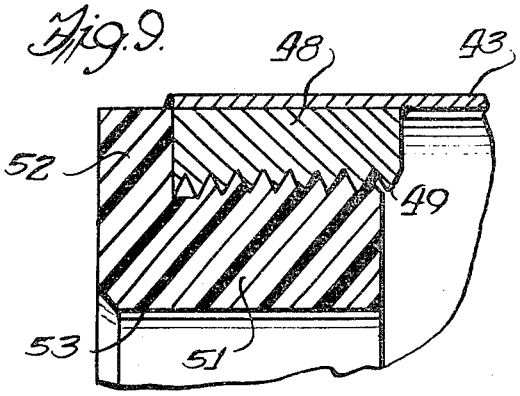
FIG. 9 is an enlarged partial cross sectional view of adapters utilized in the fitting.
Figure 10:
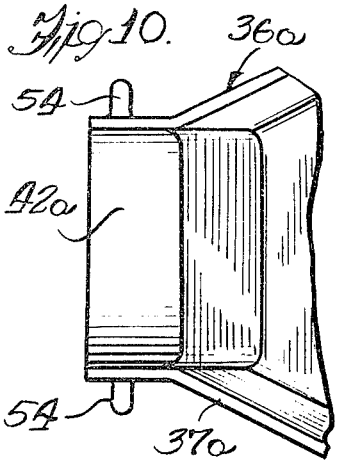
FIG. 10 is a partial enlarged top plan view of a modified piece forming one-half of a fitting.

The fitting 25 is formed of a pair of substantially identical plates 36,36, although modified plates may be used as shown in FIG. 10, the plates facing each other with abutting peripheral flanges 37,37 and oppositely disposed bubbles 38,38 at one end of the plates. Each bubble has an opening 39 defined by a flange 41 arranged to extend into the opening 34 of an adjacent 31 (see FIG. 4); the bubbles 38,38 and openings 39,39 forming a portion of the header tank 14. The plates 36,36 extend rearwardly from the tank 14 and enlarge into a pair of facing semi-cylindrical members 42,42 joined by the peripheral flanges 37,37 to provide a conduit flange 43. A second fitting 44 vertically spaced from the fitting 25 is also formed of plates 36,36 and inserted into the header tank 14 through the use of additional plates 31,31.

The fittings 25 and 44 can be utilized in a variety of ways depending on the type of insert received in the conduit flange 43. For instance, the fitting 44 has a tubular conduit member 45 received and brazed therein, the member 45 being cylindrical except for the annular embossment or enlarged bead 46 at the outer end over which a flexible hose 47 is slipped and secured by a suitable clamp (not shown).

Another type of insert is a cylindrical ring or tube 48 inserted into and brazed in the flange 43 of the fitting 25 and having an internally threaded surface 49 adapted to receive an externally threaded plug or conduit. Thus, a threaded plug with a temperature sensor or other measuring device therein could be threaded into the ring 48 for measurement of a desired characteristic of the fluid flowing within the heat exchanger. A third fitting is an externally threaded plastic ring 51 having a peripheral flange 52 at one end to abut the ring 48 and a reduced diameter smooth internal cylindrical surface 53 to receive an insert with a friction fit.

As seen in FIG. 10, one or both of the two facing plates **36*a* may have two or more outwardly extending tabs 54 formed on the flange 37*a* at the semi-cylindrical portions 42*a*; the tabs 54 being folded over the flange 37*a* of the facing plate 36*a* to retain the portions 42*a*, 42*a* together during brazing. Obviously the plates 36** could be formed as right and left handed or male and female to aid in positioning and/or joining the parts together to form the fitting.

Obviously, the fitting 25 or 43 could be used on any position in either header tank 13 or 14 as either an inlet or outlet fitting or to sealingly receive a member therein for any suitable function, such as measuring flow or temperature of the fluid or to communicate with a feeder for an additive for the fluid therein. When the heat exchanger, is assembled with the dished members 15, top plate 22 and bottom plate 23, the dished members 31 and the plates 36 are inserted in the stack at the appropriate locations and the entire assembly is brazed together, so that post braze operations are not necessary. The fitting is appropriate for a heat exchanger formed of a conventional copper-brass material, for an aluminum or aluminum alloy heat exchanger where the aluminum parts are suitably brazed together, or for stainless steel or mild steel depending on the fluids passing through the heat exchanger.

I claim:

1. An interplate fitting for a stacked plate heat exchanger wherein each plate in the stack comprises a pair of facing dished members joined by abutting peripheral flanges and having outwardly extending bubbles at the opposite ends, said bubbles of adjacent plates abutting and having axially aligned openings to form header tanks, the interplate fitting being inserted in place of a pair of abutting bubbles of two adjacent plates and having a pair of dished fitting plates provided with abutting peripheral edges and oppositely disposed bubbles having openings in axial alignment with said plate bubbles, and laterally extending semi-cylindrical conduit portions on said fitting plates communicating with said bubbles.

2. An interplate fitting as set forth in claim 1, in which a pair of modified dished members are paired with a pair of said dished members to omit said abutting bubbles of the heat exchange plates to accommodate said fitting plates.

3. An interplate fitting as set forth in claim 2, in which each modified dished member has a bubble at one end and a substantially flat surface at the opposite end having an opening therein, said modified dished member facing a dished member to provide an adjacent pair of modified heat exchange plates.

4. An interplate fitting as set forth in claim 3, in which an axial flange defines said opening in said fitting plate, said flange being received in the adjacent opening of the flat surface of a modified dished member.

5. An interplate fitting as set forth in claim 1, in which said semi-cylindrical conduit portions form a tubular fitting adapted to receive a suitable adapter member.

6. An interplate fitting as set forth in claim 5, in which said adapter member is secured within the tubular fitting.

7. An interplate fitting as set forth in claim 6, in which said adapter member comprises a tubular member having an annular embossment at one end over which a flexible hose is clamped.

8. An interplate fitting as set forth in claim 6, in which said adapter member comprises an internally threaded ring.

9. An interplate fitting as set forth in claim 8, in which an externally threaded member is inserted in the ring and has a smooth cylindrical interior surface.

10. An interplate fitting as set forth in claim 9, in which said externally threaded member is formed of plastic material and has a radial flange abutting the internally threaded ring.

* * * * *